US008099975B2

(12) United States Patent
Rafalovich et al.

(10) Patent No.: US 8,099,975 B2
(45) Date of Patent: Jan. 24, 2012

(54) ICEMAKER FOR A REFRIGERATOR

(75) Inventors: Alexander Pinkus Rafalovich, Louisville, KY (US); Omar Haidar, Louisville, KY (US); Matthew William Davis, Prospect, KY (US); Krzysztof Struminski, Louisville, KY (US); Solomon Muthumani, Andhra Pradesh (IN); Ronald Scott Tarr, Louisville, KY (US); Stephen Bischoff, Louisville, KY (US); Alvaro Delgado, Louisville, KY (US)

(73) Assignee: General Electric Company, Schenectady, NY (US)

( * ) Notice: Subject to any disclaimer, the term of this patent is extended or adjusted under 35 U.S.C. 154(b) by 516 days.

(21) Appl. No.: 11/967,681

(22) Filed: Dec. 31, 2007

(65) Prior Publication Data

US 2009/0165491 A1 Jul. 2, 2009

(51) Int. Cl.
*F25D 17/02* (2006.01)
*F25D 11/02* (2006.01)
*F25C 1/22* (2006.01)

(52) U.S. Cl. ..... 62/434; 62/340; 62/441

(58) Field of Classification Search ..... 62/340, 62/434, 430, 344, 441
See application file for complete search history.

(56) References Cited

U.S. PATENT DOCUMENTS 1,962,580 A 6/1934 Carpenter
1,992,018 A 2/1935 Steenstrup et al.
2,120,185 A 6/1938 Phillip
2,128,794 A 8/1938 Billings
2,287,225 A 6/1942 Beanblossom
2,287,255 A 6/1942 Langgaard
2,503,922 A 4/1950 Schmacher
2,514,301 A 7/1950 Tenney
2,942,432 A 6/1960 Muffly
3,788,089 A 1/1974 Graves
4,280,335 A 7/1981 Perez et al.
4,344,298 A 8/1982 Biemiller
4,907,417 A 3/1990 Forsythe
4,942,742 A 7/1990 Burruel
4,984,435 A 1/1991 Seino et al.
5,005,379 A 4/1991 Brown
5,307,642 A 5/1994 Dean
5,327,736 A 7/1994 Hino
5,406,805 A 4/1995 Radermacher et al.
5,743,109 A 4/1998 Schulak
5,964,101 A 10/1999 Schulak et al.
6,148,634 A 11/2000 Sherwood
6,205,795 B1 3/2001 Backman et al.
6,216,469 B1 4/2001 Miller
6,253,563 B1 7/2001 Ewert et al.
6,293,107 B1 9/2001 Kitagawa et al.
6,467,279 B1 10/2002 Backman et al.

(Continued)

OTHER PUBLICATIONS

U.S. Appl. No. 11/610,798, filed Dec. 14, 2006, Rafalovich et al.

(Continued)

*Primary Examiner* — Frantz Jules
*Assistant Examiner* — Cassey D Bauer
(74) *Attorney, Agent, or Firm* — Global Patent Operation; Douglas D. Zhang

(57) ABSTRACT

An icemaker having a mold comprising at least one cavity and a cooling system. The cooling system has a first heat exchanger configured to have a medium flow there through. The first heat exchanger is in thermal communication with the mold to reduce the temperature of the mold below a predetermined temperature.

24 Claims, 6 Drawing Sheets

U.S. PATENT DOCUMENTS

| | | | | |
|---|---|---|---|---|
| 6,474,093 | B1 | 11/2002 | Fink et al. | |
| 6,588,219 | B2 | 7/2003 | Zevlakis | |
| 6,655,170 | B2 | 12/2003 | Holz et al. | |
| 6,973,799 | B2 | 12/2005 | Kuehl et al. | |
| 7,051,543 | B2 | 5/2006 | Trujillo et al. | |
| 7,190,583 | B1 | 3/2007 | Fendley et al. | |
| 7,216,494 | B2 | 5/2007 | Thurman | |
| 7,216,499 | B2 * | 5/2007 | Flinner et al. | 62/233 |
| 7,322,204 | B2 | 1/2008 | Hirao et al. | |
| 7,610,773 | B2 | 11/2009 | Rafalovich et al. | |
| 2002/0088242 | A1 | 7/2002 | Williams | |
| 2004/0031280 | A1 | 2/2004 | Martin et al. | |
| 2004/0237565 | A1 * | 12/2004 | Lee et al. | 62/344 |
| 2004/0244396 | A1 | 12/2004 | Lane et al. | |
| 2005/0223730 | A1 | 10/2005 | Kester et al. | |
| 2006/0037329 | A1 * | 2/2006 | Narayanamurthy | 62/59 |
| 2007/0101761 | A1 | 5/2007 | Yanik et al. | |
| 2007/0137241 | A1 * | 6/2007 | Lee et al. | 62/340 |
| 2008/0148761 | A1 * | 6/2008 | Venkatakrishnan et al. | 62/340 |
| 2008/0156009 | A1 * | 7/2008 | Cur et al. | 62/185 |
| 2008/0156022 | A1 * | 7/2008 | LeClear et al. | 62/344 |
| 2009/0151375 | A1 | 6/2009 | Tarr et al. | |

OTHER PUBLICATIONS

U.S. Appl. No. 12/508,253, filed Jul. 23, 2009, Rafalovich et al.
U.S. Appl. No. 11/960,956, filed Dec. 20, 2007, Rafalovich et al.
U.S. Appl. No. 11/958,900, filed Dec. 18, 2007, Tarr et al.
Notice of references to related case U.S. Appl. No. 11/958,900, Sep. 16, 2010.

* cited by examiner

ICEMAKER FOR A REFRIGERATOR

BACKGROUND OF THE INVENTION

This invention relates generally to icemakers, and more particularly, to an icemaker utilizing a secondary loop cooling circuit in a refrigerator.

In a known refrigerator, an icemaker delivers ice through an opening in a door of the refrigerator. Such a known refrigerator has a freezer section to the side of a fresh food section. This type of refrigerator is often referred to as a "side-by-side" refrigerator. In the side-by-side refrigerator, the icemaker delivers ice through the door of the freezer section. In this arrangement, ice is formed by freezing water with cold air in the freezer section, the air being made cold by a cooling system that includes an evaporator.

Another known refrigerator includes a bottom freezer section disposed below a top fresh food section. This type of refrigerator is often referred to as a "bottom freezer" or "bottom mount freezer" refrigerator. In this arrangement, convenience necessitates that the icemaker deliver ice through the opening in the door of the fresh food section, rather than the freezer section. However, the cool air in the fresh food section is generally not cold enough to freeze water to form ice.

In the bottom freezer refrigerator, it is known to pump cold air, which is cooled by the evaporator of the cooling system, within an interior channel of the door of the fresh food section to the icemaker. This arrangement suffers from numerous disadvantages. For example, complicated air ducts are required within the interior of the door for the cold air to flow to the icemaker. Further, ice is made at a relatively slow rate, due to limitations on volume and/or temperature of cold air that can be pumped within the interior of the door of the fresh food section. Another disadvantage is that pumping the cold air to the fresh food compartment during ice production reduces the temperature of the fresh food compartment below the set point.

BRIEF DESCRIPTION OF THE INVENTION

In one aspect, an icemaker having a mold with at least one cavity and a cooling system. The cooling system has a first heat exchanger configured to have a medium flow there through. The first heat exchanger is in thermal communication with the mold to reduce the temperature of the mold below a predetermined temperature.

In another aspect of the invention, a refrigerator has an icemaker comprising a mold with at least one cavity and a cooling system. The cooling system has a first heat exchanger configured to have a medium flow there through. The first heat exchanger is in thermal communication with the mold to reduce the temperature of the mold below a predetermined temperature.

DETAILED DESCRIPTION OF THE INVENTION

It is contemplated that the teaching of the description set forth below is applicable to all types of refrigeration appliances, including but not limited to side-by-side and top mount refrigerators wherein undesirable temperature gradients exist within the compartments. The present invention is therefore not intended to be limited to any particular type or configuration of a refrigerator, such as refrigerator 100.

Figure 1:
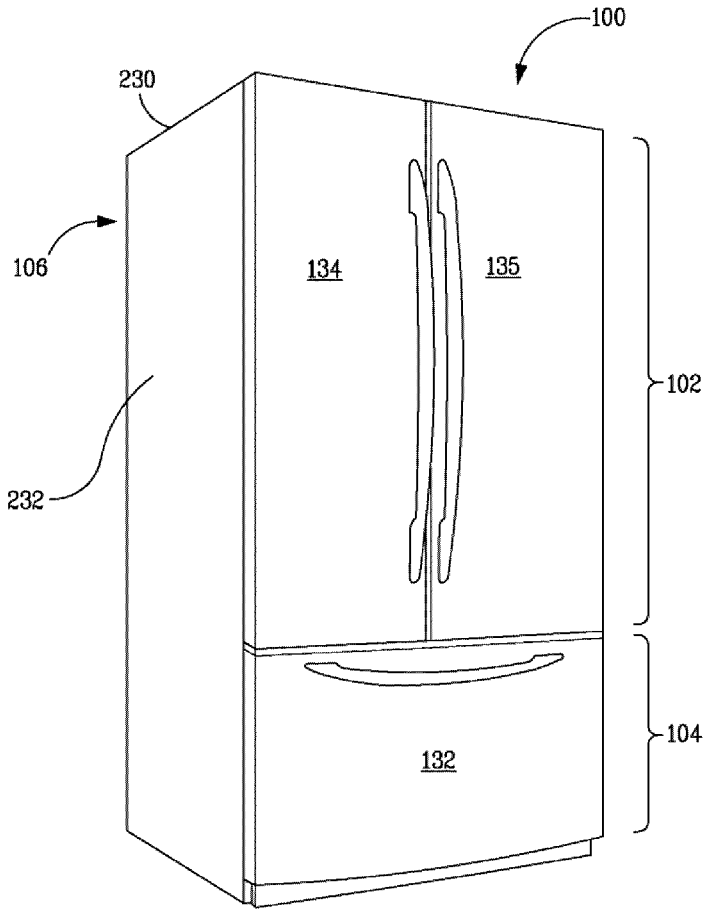
FIG. 1 is a perspective view of a refrigerator.
Figure 2:
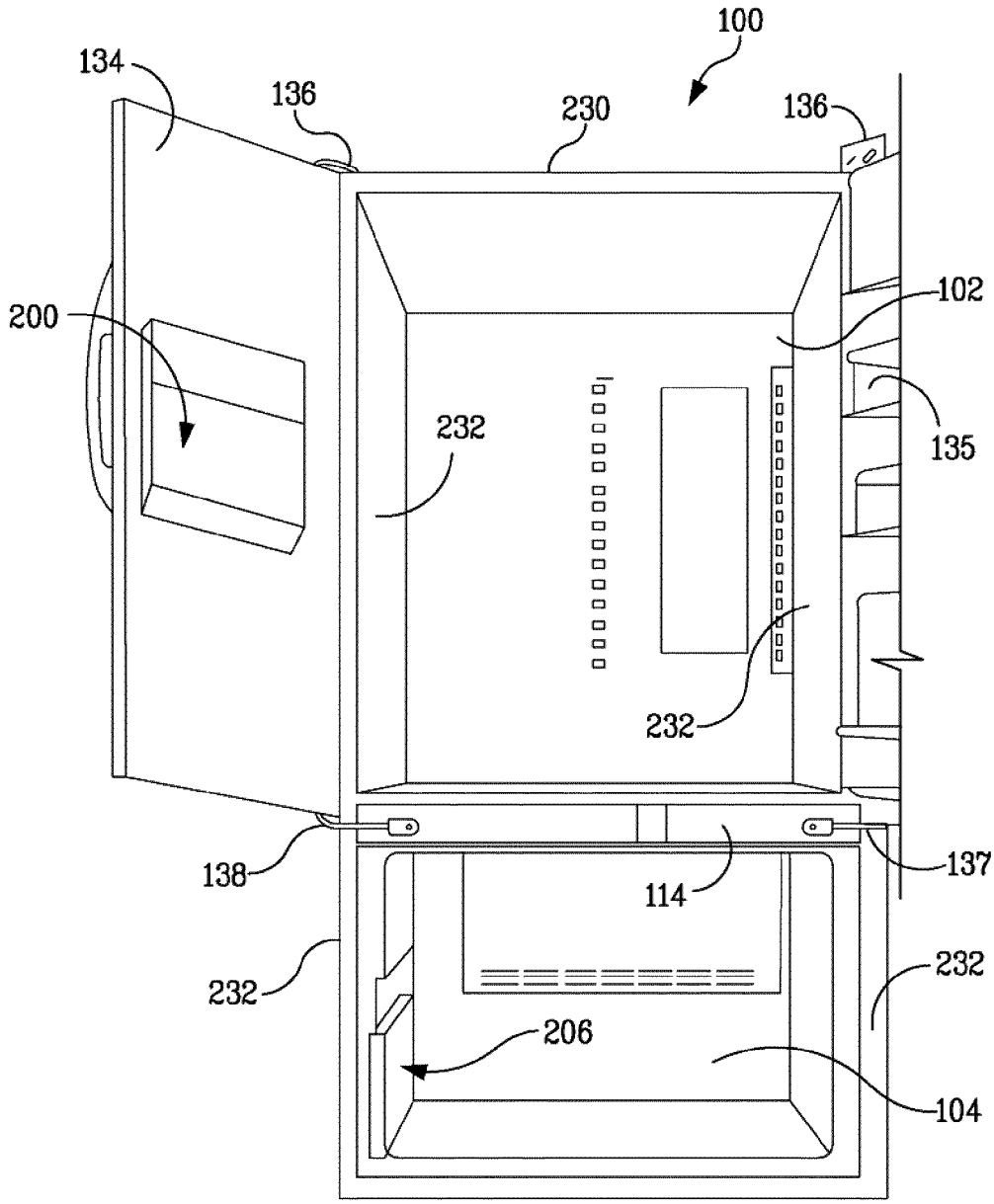
FIG. 2 is a perspective view of a refrigerator of FIG. 1 with the doors open.

FIGS. 1 and 2 illustrate a side-by-side refrigerator 100 including a fresh food compartment 102 and freezer compartment 104. Freezer compartment 104 and fresh food compartment 102 are arranged in a bottom mount configuration where the freezer compartment 104 is below the fresh food compartment 102. The fresh food compartment is shown with French opening doors 134 and 135. However, a single door may be used. Door or drawer 132 closes freezer compartment 104.

The fresh food compartment 102 and freezer compartment 104 are contained within an outer case 106. Outer case 106 normally is formed by folding a sheet of a suitable material, such as pre-painted steel, into an inverted U-shape to form top and sidewalls 230, 232 of case 106. Mullion 114 is preferably formed of an extruded ABS material. Mullion 114 separates the fresh food compartment 102 and the freezer compartment 104.

Door 132 and doors 134, 135 close access openings to freezer and fresh food compartments 104, 102, respectively. Each door 134 and 135 is mounted by a top hinge 136 and a bottom hinge 137 to rotate about its outer vertically oriented edge between an open position, as shown in FIG. 2, and a closed position shown in FIG. 1 closing the associated storage compartment.

In accordance with known refrigerators, refrigerator 100 also includes a machinery compartment (not shown) that at least partially contains components for executing a known vapor compression cycle for cooling air in the compartments. The components include a compressor (not shown), a condenser (not shown), an expansion device (not shown), and an evaporator (not shown) connected in series and charged with a refrigerant. The evaporator is a type of heat exchanger that transfers heat from air passing over the evaporator to a refrigerant flowing through the evaporator, thereby causing the refrigerant to vaporize. The cooled air is used to refrigerate one or more fresh food or freezer compartments via fans (not shown). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator 100.

The icemaker 200 is configured to produce ice, and to provide the produced ice through an opening in a door of the fresh food compartment 102. It is contemplated that the icemaker 200 can be used with a bottom freezer refrigerator, in which the bottom freezer compartment is disposed below a top fresh food compartment. It is understood, however, that the icemaker 200 is not limited to use in the bottom freezer refrigerator. For example, the icemaker 200 can be configured to produce ice and to provide the produced ice through an opening in a door of a fresh food compartment of a side-by-side refrigerator in which the freezer compartment is disposed to the side of the fresh food compartment. Alternately, the icemaker 200 can be disposed in various refrigerators in which the fresh food and freezer compartments are disposed in a variety of positions relative to one another. It is further understood that the refrigerator in which the icemaker 200 is disposed is not required to have one or only one of each of the fresh food and freezer compartments, but rather can include none, or one or more of each of the fresh food and freezer compartments. By way of non-limiting examples, the icemaker 200 can be disposed in the refrigerator that includes one or more fresh food compartments and no freezer compartment, or that includes one or more freezer compartments and no fresh food compartment.

The icemaker 200 is provided in addition to the freezer compartment cooling system 210, and produces and provides ice separate from operation of the freezer compartment cooling system 210. By this arrangement, disadvantages associated with a known icemaker, particularly in a bottom freezer refrigerator, are overcome. Specifically, in embodiments of the invention, ice is produced at a faster rate because ice production is not dependent on a volume or temperature of cold air that can be pumped within a channel interior of the door of the fresh food compartment.

Figure 4:
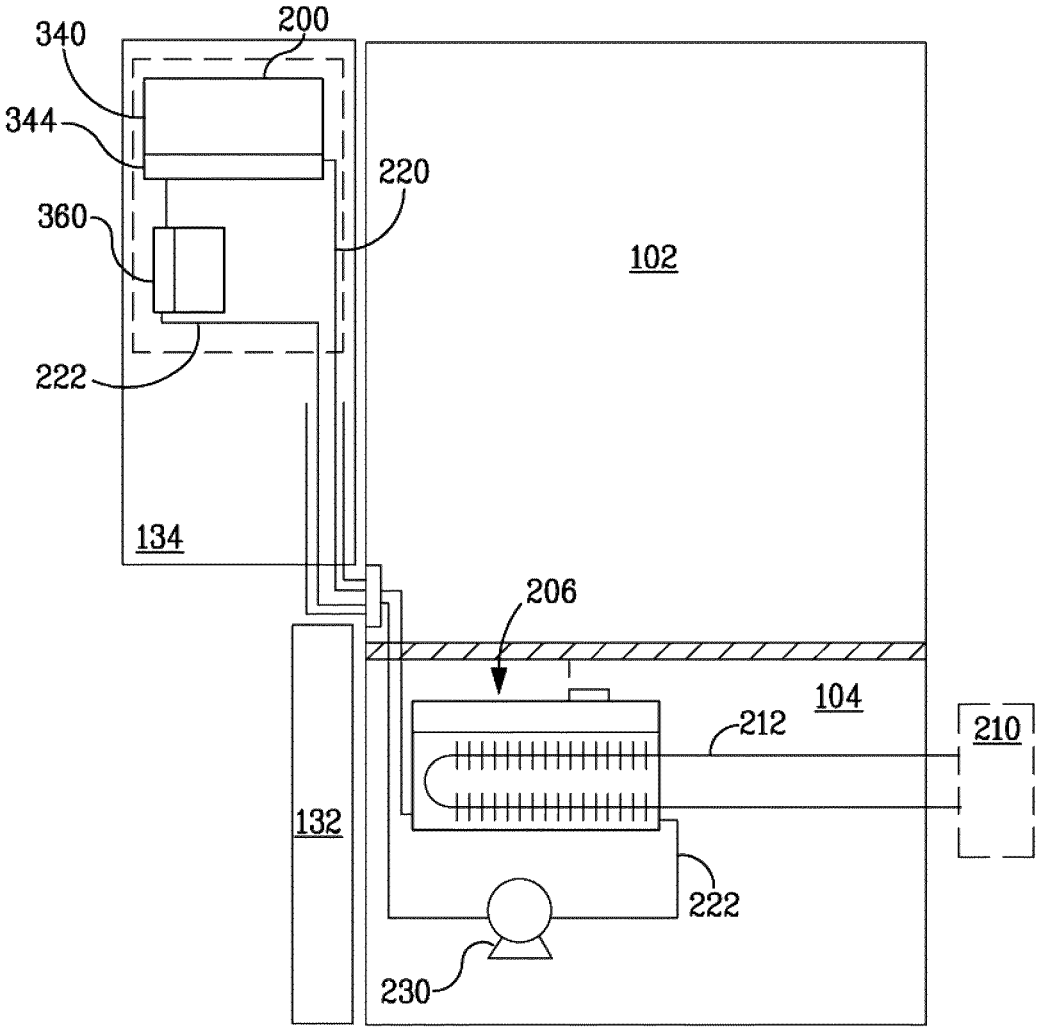
FIG. 4 is a diagram of an exemplary embodiment of a secondary loop cooling system with the icemaker of FIG. 3.

FIG. 4 shows an exemplary secondary loop cooling system for use with icemaker 200. The secondary loop cooling system includes a medium storage tank 206 configured to hold a medium such as a propylene glycol and water mixture. Tank 206 is flow connected outlet line 220 and inlet line 222. Outlet line 220 enters the heat exchanger 344 of ice-forming device 340. The heat exchanger of the ice-forming device is flow connected with the heat exchanger 360 of the ice receptacle 350.

A pump 230 is configured to pump the medium within the lines 220 222 between the heat exchangers 344, 360 and the medium storage tank 206. Typically, the pump will move the medium from the medium storage tank 206 in line 220 to the icemaker 200 and back to the storage tank in line 222. The pump 230 may be placed in any effective location to accomplish the movement of the medium. In the storage tank 206 the medium is cooled through heat transfer to a predetermined temperature. This temperature is preferably below the standard freezing point of water. As shown, a closed loop 212 of the freezer compartment cooling system 210 may be used to cool the medium in storage tank 206. However, the storage tank 206 may be configured also to transfer heat to the freezer compartment, which is then cooled by the primary loop of the freezer compartment cooling system 210.

Figure 5:
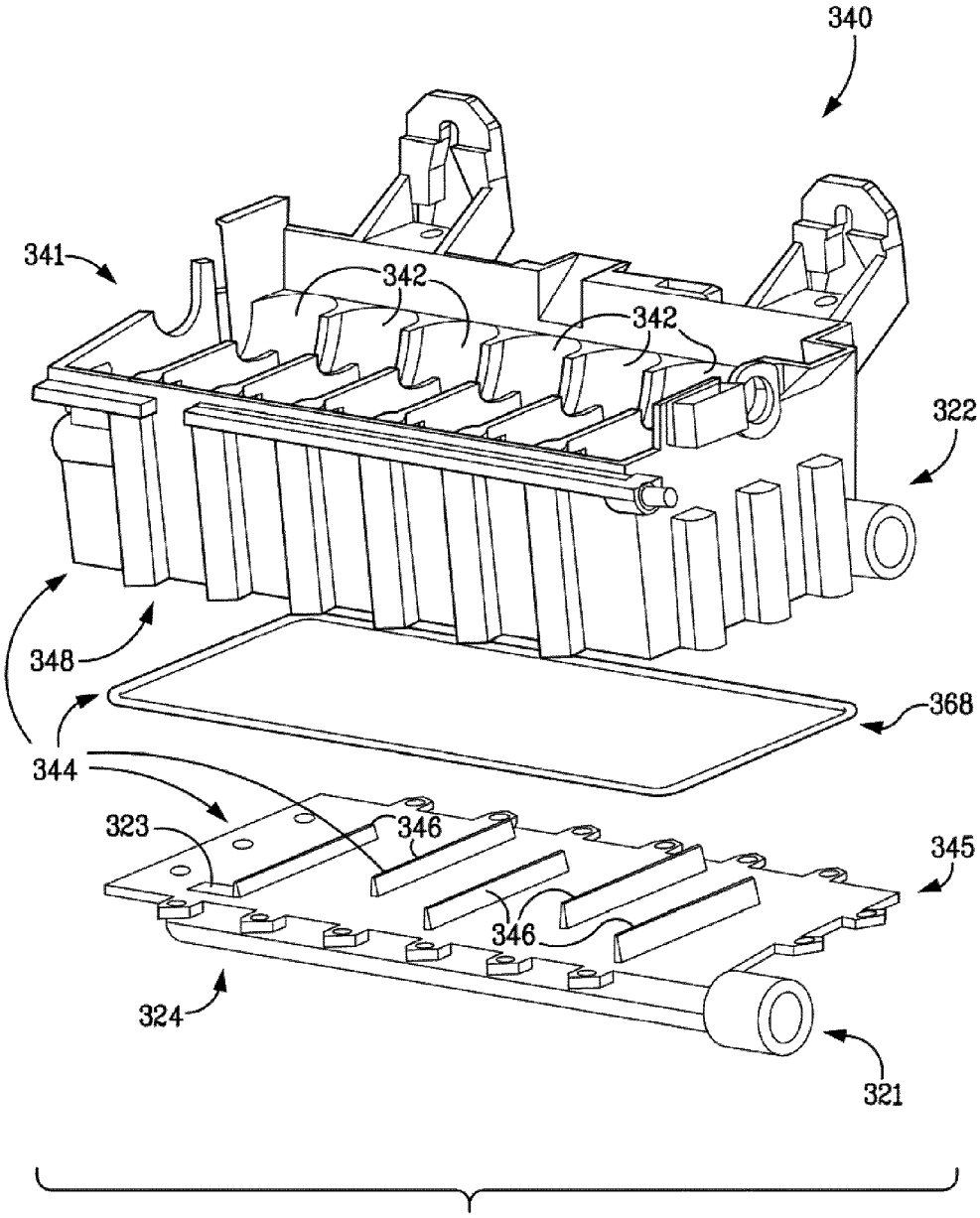
FIG. 5 is a perspective view of the ice-forming device of the icemaker of FIG. 3.

As shown in FIG. 5, the cooled medium flows through an ice-forming device 340 configured to freeze water to produce ice. The ice-forming device 340 includes an ice mold 341. The ice mold 341 includes one or more cavities 342 configured to receive water from an outside water source (e.g., from a water line), and to retain the water during freezing.

The ice forming device 340 also includes a heat exchanger portion 344 disposed adjacent (e.g., near or as a portion of) the cavities 342 of the ice mold 341. It is contemplated that in embodiments of the invention, the heat exchanger 344 has one or more channels formed, cast, molded or otherwise provided in a bottom of the ice mold 341 and/or the ice-forming device 340.

As shown, the heat exchanger portion 344 is formed by incorporating a cavity having a flat bottom, not shown in detail, in the base 348 of the ice mold 341 and closing the cavity with a cover 345. The cover 345, in combination with alternating ribs 346, forms channels to direct the flow of the medium through the heat exchanger 344. It is contemplated that the ribs may be formed in the cavity of the base 348 and the cover 345 may be flat or both the cavity and the cover may contain ribs. An o-ring gasket 368 or other similar sealing means is used to prevent leaking of the medium during operation. It is contemplated that cover 345 maybe brazed or welded or molded together with ice mold 341.

By this arrangement, the cooled medium enters the ice-forming device 340 at port 322. The cooled medium flows through the heat exchanger 344 absorbing heat from the mass of ice forming device 340. After moving past the ribs 346 the medium flows into channel 324 through opening 323. Channel 324 directs the medium to exit port 321 after flowing though heat exchanger 344. Line 220 is flow connected to heat exchanger 344 at port 321.

The water retained in the cavities 342 is cooled by the reduced temperature of the mass of ice-forming device 340 to a temperature equal to or less than the standard freezing point temperature of water. As a result, the water retained in the cavities 342 of the ice mold 341 freezes, producing ice cubes.

In an alternate embodiment, the ice-forming device 340 may be made hollow with thin-formed exterior walls, not shown. In this alternate embodiment, the volume of medium present within ice forming device 340 acts as the mass for removing heat from water in the cavities 342.

After the ice is formed it may be harvested in any conventional manner. For the ice-forming device 340, a rack style harvester, not shown, is most common. The rack type harvester then utilizes rotating fingers to scoop the ice cubes out of the cavities 342. Those of ordinary skill in the art know features of a rack harvester, and therefore further explanation is not required to provide a complete written description of embodiments of the invention or to enable those of ordinary skill in the art to make and use embodiments of the invention, and is not provided. Once harvested the ice cubes are stored in an ice receptacle 350.

Figure 6:
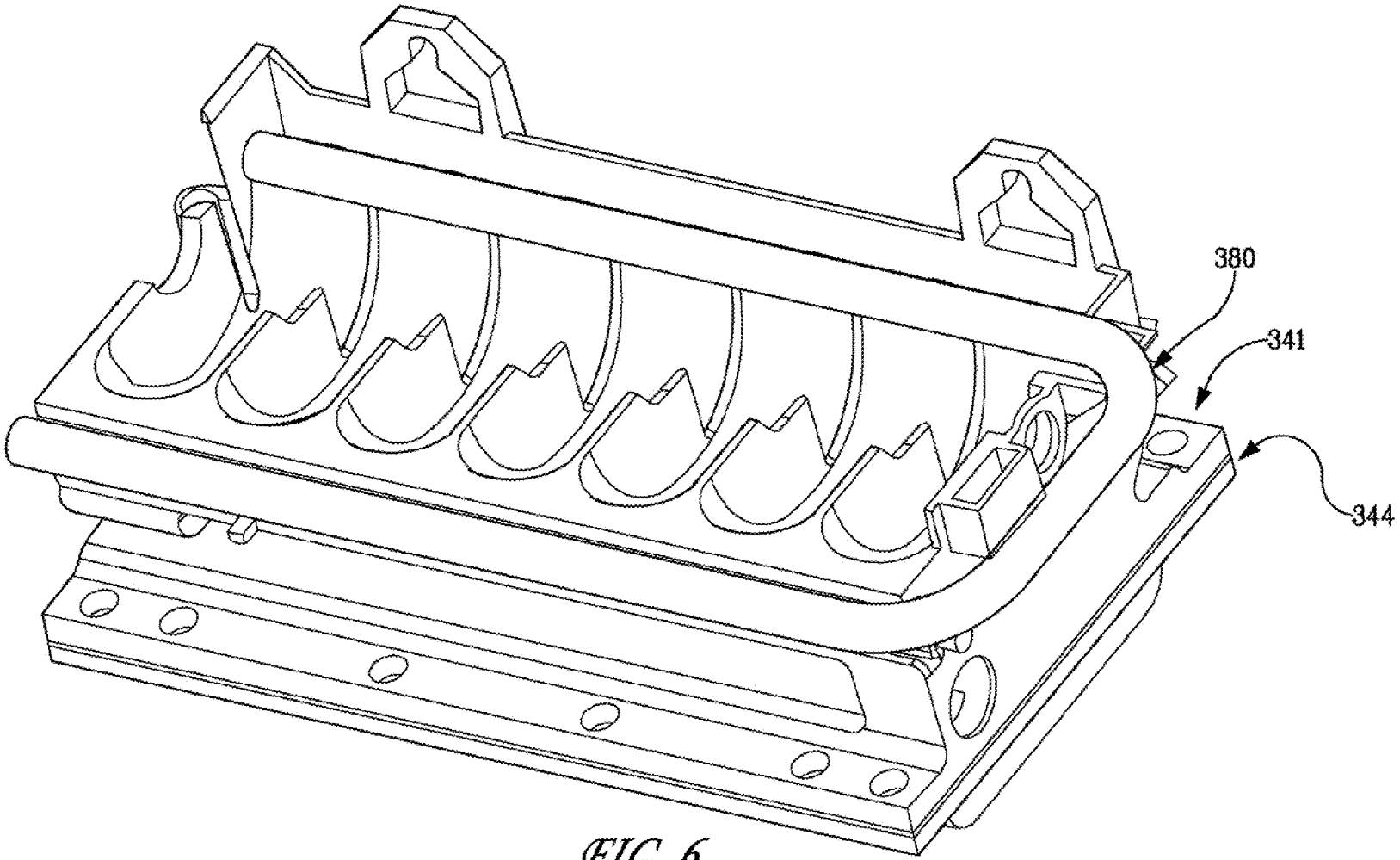
FIG. 6 is an exemplary view of a heater for the ice-forming device of the icemaker of FIG. 3.

During harvesting the temperature of the cavities 342 is raised above the freezing point of water. This rise in temperature melts a thin layer of the ice cube releasing the ice cube from the cavity 342. As shown in FIG. 6, to raise the temperature a cal rod heater 380 is wrapped around the exterior of or incorporated into the sides of ice mold 341. Alternatively, an electric resistance wire heater may be molded into the ice mold 341 to facilitate the rise in temperature.

Figure 3:
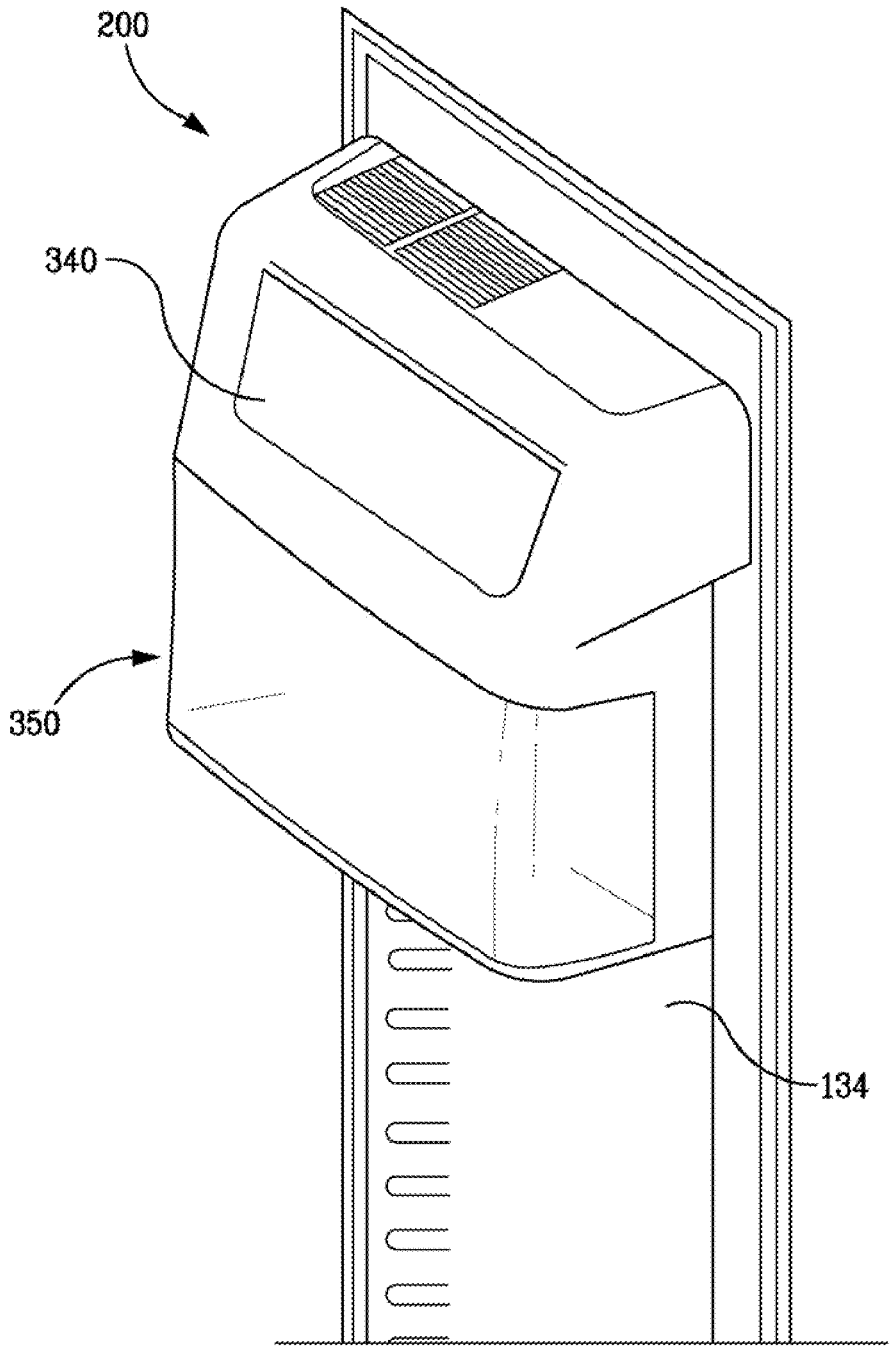
FIG. 3 is a perspective view of an exemplary icemaker according to an aspect of the invention.

An ice delivery system is formed by the ice receptacle 350 of FIG. 3, which is configured to receive the ice cubes from the ice-forming device 340 either directly or through a channel or funnel, and to retain the ice cubes therein. Details of an ice delivery system configured to deliver ice cubes from the ice forming device 340 to the ice receptacle 350, whether separate from or as a component of the ice forming device 340 and/or the ice receptacle 350, are also known, and are therefore neither required nor provided.

In embodiments of the invention, shown schematically in FIG. 4, a heat exchanger 360 is disposed adjacent an ice receptacle 350 with the medium flowing through the heat exchanger 360 subsequent to flowing through the heat exchanger 344 of the ice forming device 340. Thus, the medium used during the production of ice is further warmed, absorbing heat from a volume adjacent the ice receptacle 350. As a result, melting of ice retained within the ice receptacle 350 is impeded or prevented.

In embodiments of the invention, it is contemplated that the temperature of the warmed medium flowing through the heat exchanger 360 is still less than the standard freezing point temperature of water, such that melting of ice in the ice receptacle 350 is prevented. It is to be understood, however, that the heat exchanger 360 is not required in the icemaker 200, and that in alternate embodiments the melting of ice retained within the ice receptacle 350 is impeded or prevented without the use of the heat exchanger 360. In such alternate embodiments, the ice receptacle 350 is disposed adjacent the ice forming device 340 and/or the heat exchanger 344. As a result, ice in the ice receptacle is prevented from melting as a result of cooling by the heat exchanger 344. For example, when the ice receptacle 350 is disposed below the ice forming device 340 and the heat exchanger 344, cold air flows from the heat exchanger 344 to the ice receptacle 350 as a result of natural convention.

After the warmed medium exits icemaker 200 the medium flows back to the medium storage tank 206. Continued operation of the icemaker 200 is provided by repetition of the above-described flow of the medium from the medium storage tank 206 through tubing 220 to heat exchangers 344 and 360, among the other components of the icemaker 200, and back to storage tank 206 in tubing 222.

Still further, details of an ice delivery system configured to deliver ice from the ice receptacle 350 through the opening in the door of the fresh food compartment 102 are known and thus not discussed.

The above-described medium path is for illustration purposes only. Specifically, refrigerant flows through the closed loop 212 of the freezer compartment cooling system 210, while the medium flows through the storage tank 206. In an alternate embodiment, a refrigeration coil for the fresh food compartment may be used. In yet another embodiment, the storage tank 206 may have heat removed by the convection of air in the freezer compartment.

In embodiments of the invention, the refrigerant of the closed loop 212 has an evaporation temperature of less than about 0 degrees Celsius. Further, in embodiments of the invention, the medium is propylene glycol and water, commonly referred to as "anti-freeze," and is cooled in the storage tank 206 to a temperature well below the standard freezing point temperature of water.

In embodiments of the invention shown in the drawings, the storage tank 206 and the heat exchangers 344 and 360 are disposed downstream from one another, respectively, without intervening heat exchangers disposed there between. It is understood, however, that this efficient arrangement is not required, and other intervening heat exchangers may be included. Further, the heat exchanger 360 is not required to be disposed downstream of the heat exchanger 344, and the heat exchanger 360 can be disposed upstream of the heat exchanger 344. Similarly, the storage tank 206 and/or the pump 230 can be disposed at various locations within the refrigerator 100, and therefore the depicted and described locations are understood not to limit the locations of these components.

Similarly, components of the icemaker 200 also can be disposed in various locations within the refrigerator 100, and are not limited to those exemplary locations depicted in the drawings. It is contemplated that in embodiments of the invention the storage tank 206 and the pump 230 are disposed next to a back wall of the freezer compartment 104 and behind a freezer evaporator cover. The medium is cooled by the absorption of heat by the refrigerant undergoing expansion, in the manner described above. However, these components are not limited to such locations within the refrigerator 100.

While the invention has been described in terms of various specific embodiments, those skilled in the art will recognize that the invention can be practiced with modification within the spirit and scope of the claims.

The invention claimed is:

1. An appliance comprising:

a first storage compartment;

a second storage compartment;

a third storage compartment disposed in the second storage compartment;

an ice forming device disposed in the third storage compartment and comprising an ice mold having a plurality of ice-forming cavities;

a primary loop cooling system containing a first cooling medium and configured to directly cool the first storage compartment and the second storage compartment; and a secondary loop cooling system containing a second cooling medium, the first cooling medium and the second cooling medium being of different types, the secondary loop cooling system comprising:

a first heat exchanger in thermal communication with the ice mold to reduce a temperature of the ice mold below a predetermined temperature; and a second heat exchanger in flow communication with the first heat exchanger, the second heat exchanger being in thermal communication with the primary loop cooling system so that the second cooling medium is cooled by the primary loop cooling system;

the primary loop cooling system comprising a third heat exchanger in direct contact with the second cooling medium within the second heat exchanger.

2. The appliance of claim 1, further comprising a door permitting or prohibiting access to an interior of the second storage compartment, the third storage compartment being on the door.

3. The appliance of claim 2, further comprising an ice receptacle disposed in the third storage compartment and below the ice mold.

4. The appliance of claim 3, wherein the secondary loop cooling system further comprises a fourth heat exchanger in flow communication with the first heat exchanger, the fourth heat exchanger being disposed in the third storage compartment and in thermal communication with the ice receptacle for cooling the ice receptacle.

5. The appliance of claim 1, wherein the second heat exchanger comprises a medium storage tank.

6. The appliance of claim 1, wherein the secondary loop cooling system further comprises a pump for circulating the second cooling medium in the secondary loop cooling system.

7. The appliance of claim 4, wherein the secondary loop cooling system further comprises a pump for circulating the second cooling medium within the secondary loop cooling system.

8. The appliance of claim 1, wherein the second cooling medium comprises a mixture of water and propylene glycol.

9. The appliance of claim 1, wherein the appliance is a refrigerator.

10. The appliance of claim 9, wherein the second storage compartment is a fresh food compartment.

11. The refrigerator of claim 10, wherein the first storage compartment is a freezer compartment.

12. The refrigerator of claim 1, wherein the ice forming device further comprises a heater, which heats the ice mold during ice harvest.

13. A refrigerator comprising:

a fresh food compartment;

an ice compartment disposed in the fresh food compartment;

an ice forming device disposed in the fresh food compartment and comprising an ice mold having a plurality of ice-forming cavities;

a primary loop cooling system containing a first cooling medium and configured to directly cool the fresh food compartment; and a secondary loop cooling system containing a second cooling medium, the first cooling medium and the second cooling medium being of different types, the secondary loop cooling system comprising:

a first heat exchanger in thermal communication with the ice mold to reduce a temperature of the ice mold below a predetermined temperature; and a second heat exchanger in flow communication with the first heat exchanger, the second heat exchanger being in thermal communication with the primary loop cooling system so that the second cooling medium is cooled by the primary loop cooling system;

the primary loop cooling system comprising a third heat exchanger in direct contact with the second cooling medium within the second heat exchanger.

14. The refrigerator of claim 13, further comprising a door permitting or prohibiting access to an interior of the fresh food compartment, the ice compartment being on the door.

15. The refrigerator of claim 14, further comprising an ice receptacle disposed in the ice compartment and below the ice mold.

16. The refrigerator of claim 15, wherein the secondary loop cooling system further comprises a fourth heat exchanger in flow communication with the first heat exchanger, the fourth heat exchanger being disposed in the ice compartment and in thermal communication with the ice receptacle for cooling the ice receptacle.

17. The refrigerator of claim 13, wherein the second heat exchanger comprises a medium storage tank.

18. The refrigerator of claim 13, wherein the secondary loop cooling system further comprises a pump for circulating the second cooling medium in the secondary loop cooling system.

19. The refrigerator of claim 16, wherein the secondary loop cooling system further comprises a pump for circulating the second cooling medium in the secondary loop cooling system.

20. The refrigerator of claim 13, wherein the second cooling medium comprises a mixture of water and propylene glycol.

21. The refrigerator of claim 13, further comprising a freezer compartment, the primary loop cooling system comprising an evaporator, which, during operation, cools the fresh food compartment, the freezer compartment and the second heat exchanger of the secondary loop cooling system.

22. The refrigerator of claim 13, wherein the ice forming device further comprises a heater, which heats the ice mold during ice harvest.

23. The refrigerator of claim 13, wherein the first heat exchanger comprises a cover and a part of the ice forming device, which form a cavity therebetween, the first heat exchanger further comprising a plurality of alternating ribs disposed in the cavity and attached to at least one of the cover and the part of the ice forming device.

24. The appliance of claim 1, wherein the first heat exchanger comprises a cover and a part of the ice forming device, which form a cavity therebetween, the first heat exchanger further comprising a plurality of alternating ribs disposed in the cavity and attached to at least one of the cover and the part of the ice forming device.

* * * * *